US006321704B1

(12) United States Patent
Church et al.

(10) Patent No.: US 6,321,704 B1
(45) Date of Patent: Nov. 27, 2001

(54) HYDRAULICALLY ACTUATED LATCHING VALVE DEACTIVATION

(75) Inventors: Kynan L. Church; Austin R. Zurface, both of Ceresco; Keith Hampton, Ann Arbor, all of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/533,832

(22) Filed: Mar. 23, 2000

Related U.S. Application Data

(63) Continuation-in-part of application No. 09/255,366, filed on Feb. 23, 1999.

(51) Int. Cl.[7] ..... F01L 13/00; F02D 13/02

(52) U.S. Cl. ..... 123/90.16; 123/90.41; 123/198 F; 123/90.5; 123/90.55; 123/90.43

(58) Field of Search ..... 123/90.15, 90.16, 123/90.39, 90.41, 90.43, 198 F, 90.48, 90.49, 90.5, 90.55

(56) References Cited

U.S. PATENT DOCUMENTS 5,655,487 * 8/1997 Maas et al. ..... 123/90.16
5,720,244 * 2/1998 Faria ..... 123/90.16
5,875,748 * 3/1999 Haas et al. ..... 123/90.16

* cited by examiner

*Primary Examiner*—Weilun Lo
(74) *Attorney, Agent, or Firm*—L. J. Kasper

(57) ABSTRACT

The invention is a valve deactivator assembly (15) for use in connection with a valve train of an internal combustion engine. In application, a pre-selected number of the engine cylinders would each be equipped with a deactivator connected to its intake engine valve. Upon driver selection or predetermined road conditions, sufficient lost motion would be introduced into the valve train so that the valve would remain closed and the cylinder deactivated as the engine is in operation. The deactivator has in its inner body (19) a latch assembly that is in a latched condition for normal operation of the valve train. When it is desired to retain the valve in the closed position and deactivate a cylinder, the latch assembly is caused to be moved to the unlatched condition by increase in the pressure of the engine oil. When the latch assembly is unlatched, significant lost motion is introduced into the valve train causing the valve to remain closed and the cylinder is deactivated.

7 Claims, 5 Drawing Sheets

HYDRAULICALLY ACTUATED LATCHING VALVE DEACTIVATION

CROSS-REFERENCE TO RELATED APPLICATIONS

This application is a continuation-in-part (CIP) of co-pending application U.S. Ser. No. 09/255,366, filed Feb. 23, 1999, in the name of Kynan L. Church for a "Hydraulically Actuated Valve Deactivating Roller Follower".

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an improved valve train for an internal combustion engine, and more particularly, to a valve deactivator assembly for use therein, and even more particularly, to such a valve deactivator of the type utilizing a latching pin arrangement.

Although the valve deactivator assembly of the present invention may be utilized to introduce some additional lash into the valve train, such that the valves open and close by an amount less than the normal opening and closing, the invention is especially suited for introducing into the valve train sufficient lash (also referred to hereinafter as "lost motion"), such that the valves no longer open and close at all, and the invention will be described in connection therewith.

Valve deactivators of the general type to which the invention relates are known, especially in connection with internal combustion engines having push rod type valve gear train. In such a gear train, there is a rocker arm, with one end of the rocker arm engaging a push rod, and the other end engaging the engine poppet valve. Typically, a central portion of the rocker arm is fixed relative to the cylinder head (or other suitable structure) by a fulcrum arrangement as is well known to those skilled in the art, in which the fulcrum normally prevents movement of the central portion of the rocker arm in an "up and down" direction. At the same time, the fulcrum permits the rocker arm to engage in cyclical, pivotal movement, in response to the cyclical movement of the push rod, which results in the engagement of the push rod with the lobes of a rotating cam shaft.

There are a number of known valve deactivator assemblies which are operably associated with the fulcrum portion of the rocker arm in a push rod type valve gear train. Such known valve deactivator assemblies, when in the latched condition, restrain the fulcrum portion of the rocker arm to cause the rocker arm to move in its normal cyclical, pivotal movement. However, in an unlatched condition, the valve deactivator assembly permits the fulcrum portion of the rocker arm to engage in "lost motion" such that the cyclical, pivotal movement of the push rod causes the rocker arm to undergo cyclical, pivotal movement about the end which is in engagement with the engine poppet valve. In other words, the rocker arm merely pivots, but the engine poppet valve does not move, and hence, is in its deactivated condition.

A different approach to valve deactivation in a push rod type valve gear train is illustrated and described in copending application U.S.S.N. 09/255,366, filed Feb. 23, 1999 in the name of Kynan L. Church for a "Hydraulically Actuated Valve Deactivating Roller Follower". In the copending application, the valve deactivation is accomplished in a roller follower of a type having an outer body which moves with the roller follower, and an inner body which imparts motion to the push rod. The valve deactivator has either an unlatched condition, in which lost motion occurs, or a latched condition, in which the inner and outer bodies are latched to each other and motion imparted to the roller follower by the cam is, in turn, transmitted to the push rod to provide normal valve opening and closing.

A generally similar type of valve deactivator is illustrated and described in U.S. Pat. No. 5,655,487, for use in an overhead cam ("OHC") engine, of the type utilizing an end pivot rocker arm. In a valve gear train of the type described above, the pivot point for the end of the rocker arm is a hydraulic lash adjuster ("HLA"), with the opposite end of the rocker arm being in engagement with the engine poppet valve.

In the valve deactivator of the above-cited patent, the latching arrangement between the inner and outer bodies is configured such that the inner body must be maintained in a predetermined rotational orientation within the outer body, in order for proper latching and unlatching to occur. Such a need for maintaining rotational orientation of the inner body member, relative to the outer body member, adds substantially to the overall complexity and cost of both the manufacture and assembly of the valve deactivating HLA. In connection with the development of the present invention, it has also been determined that another disadvantage of the valve deactivator of the cited patent is that, when the latching mechanism is latched, all of the gear train force being supported by the latching mechanism is being carried over a relatively small area, thus resulting in higher than desirable surface stresses in the latch mechanism.

BRIEF SUMMARY OF THE INVENTION

Accordingly, it is an object of the present invention to provide an improved valve deactivator assembly which overcomes the above-described disadvantages of the prior art.

It is a more specific object of the present invention to provide an improved valve deactivator assembly wherein the inner body member does not need to be in any particular rotational orientation relative to the outer body member, in order for proper latching and unlatching to occur.

It is a related object of the present invention to provide an improved valve deactivating HLA for use in OHC valve gear train of the end pivot rocker arm type, in which the HLA is reasonably compact, to minimize the need for overall re-design of the valve gear train.

The above and other objects of the invention are accomplished by the provision of an improved valve deactivator assembly for an internal combustion engine of the type having valve means for controlling the flow to and from a combustion chamber, drive means for providing cyclical motion for opening and closing the valve means in timed relationship to the events in the combustion chamber, and valve gear means operative in response to the cyclical motion to effect cyclical opening and closing of the valve means. The valve deactivator assembly comprises part of the valve gear means and includes an outer body member and an inner body member disposed within the outer body member and being reciprocable relative thereto, and a spring biasing the inner body member toward an axially extended position relative to the outer body member. A latch assembly is wholly disposed within the inner body member when the outer and inner body members are in an unlatched condition, the latch assembly including a radially moveable latch member and spring means biasing the latch member toward a latched condition. A source of pressurized fluid is operably associated with the latch assembly and is operable to bias the latch member toward the unlatched condition.

The improved valve deactivator assembly is characterized by the latch assembly further comprising the outer body member defining a generally annular, internal groove including an annular latch surface and at least one fluid port disposed in open fluid communication with the annular internal groove and in fluid communication with the source of pressurized fluid. The latch member defines a generally planar stop surface oriented generally parallel to the annular latch surface and disposed for face-to-face engagement therewith when the latch member is in the latched condition, whereby the inner body member may be in any rotational orientation relative to the outer body member.

DETAILED DESCRIPTION OF THE PREFERRED EMBODIMENT

Figure 1:
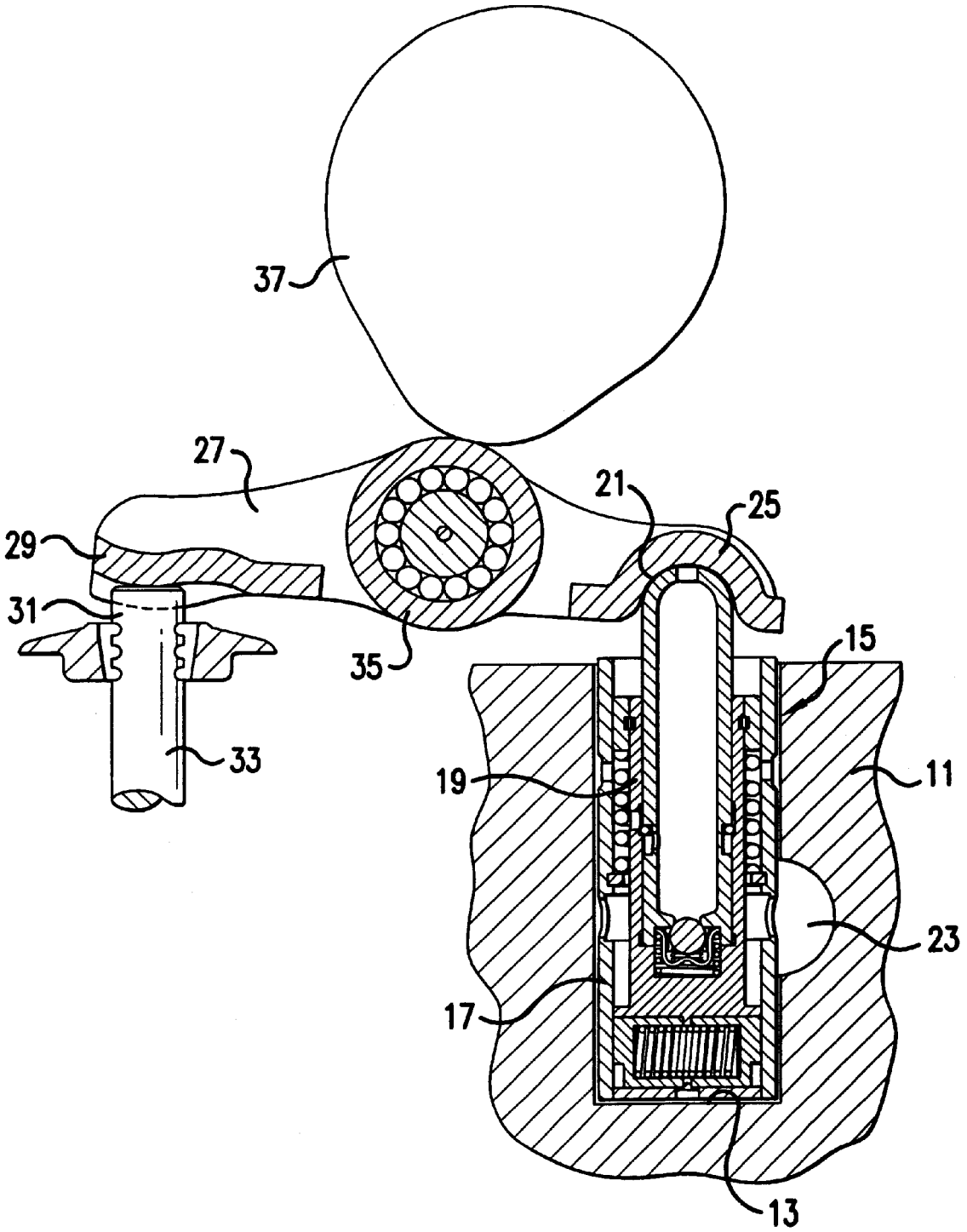
FIG. 1 is a fragmentary, axial cross-section taken through a vehicle internal combustion engine, illustrating a typical valve gear train of the type with which the present invention may be utilized.

Referring now to the drawings, which are not intended to limit the invention, there is illustrated, by way of example only, an OHC valve gear train of the type which may utilize the valve deactivator assembly of the present invention. In FIG. 1, there is shown fragmentarily a cylinder head 11 of an internal combustion engine. The cylinder head 11 defines a generally cylindrical bore 13 within which is disposed a valve deactivator assembly, generally designated 15.

The valve deactivator assembly 15 includes an outer body member 17, an inner body member 19, and a plunger element (to be described subsequently) which includes a ball plunger portion 21. As is well known to those skilled in the art, the cylinder head 11 also defines an engine oil passage 23 which intersects the bore 13, and by means of which pressurized oil is communicated to the valve deactivator assembly 15, as will be described in greater detail subsequently.

Referring still primarily to FIG. 1, the ball plunger portion 21 is received within a hemispherical socket 25 of a rocker arm 27. At the end of the rocker arm 27 opposite the socket 25 is a valve contacting pad 29, the underside of which is in engagement with the tip 31 of an engine poppet valve 33 (of which only the upper portion of the stem is shown). The rocker arm 27 includes a rotatable cam follower 35, which is in engagement with the surface of a valve actuating cam 37.

Typically, but by way of example only, the present invention would be utilized with an eight cylinder engine for which the valve gear train would include eight pairs of intake and exhaust valve rocker arms, with four of the eight being equipped with the valve deactivator assembly 15 of the present invention. In other words, four of the eight cylinders could be selectively deactivated by introducing sufficient lost motion into the valve drive train for that particular valve, so that the cyclical motion of the cam 37 does not result in any corresponding cyclical opening and closing movement of the poppet valve 33 (i.e., of either the intake valve or the exhaust valve for that particular cylinder). Under the "deactivated" condition described, the engine poppet valve 33 remains closed under the influence of a valve closing spring (not shown herein). It would also be typical that, for the four cylinders which cannot be selectively deactivated, the socket 25 of the rocker arm 27 would engage the ball plunger portion of a "conventional" hydraulic lash adjuster, i.e., an HLA not having valve deactivation capability.

When the lobe of the cam 37 engages the follower 35 (as shown in FIG. 1), under normal operating conditions, the ball plunger portion 21 would comprise the pivot point for the rocker arm 27, such that the rocker arm would pivot about the ball plunger portion 21 as the follower 35 is engaged by the cam lobe 37, thus forcing the engine poppet valve 33 in a downward direction.

Figure 2:
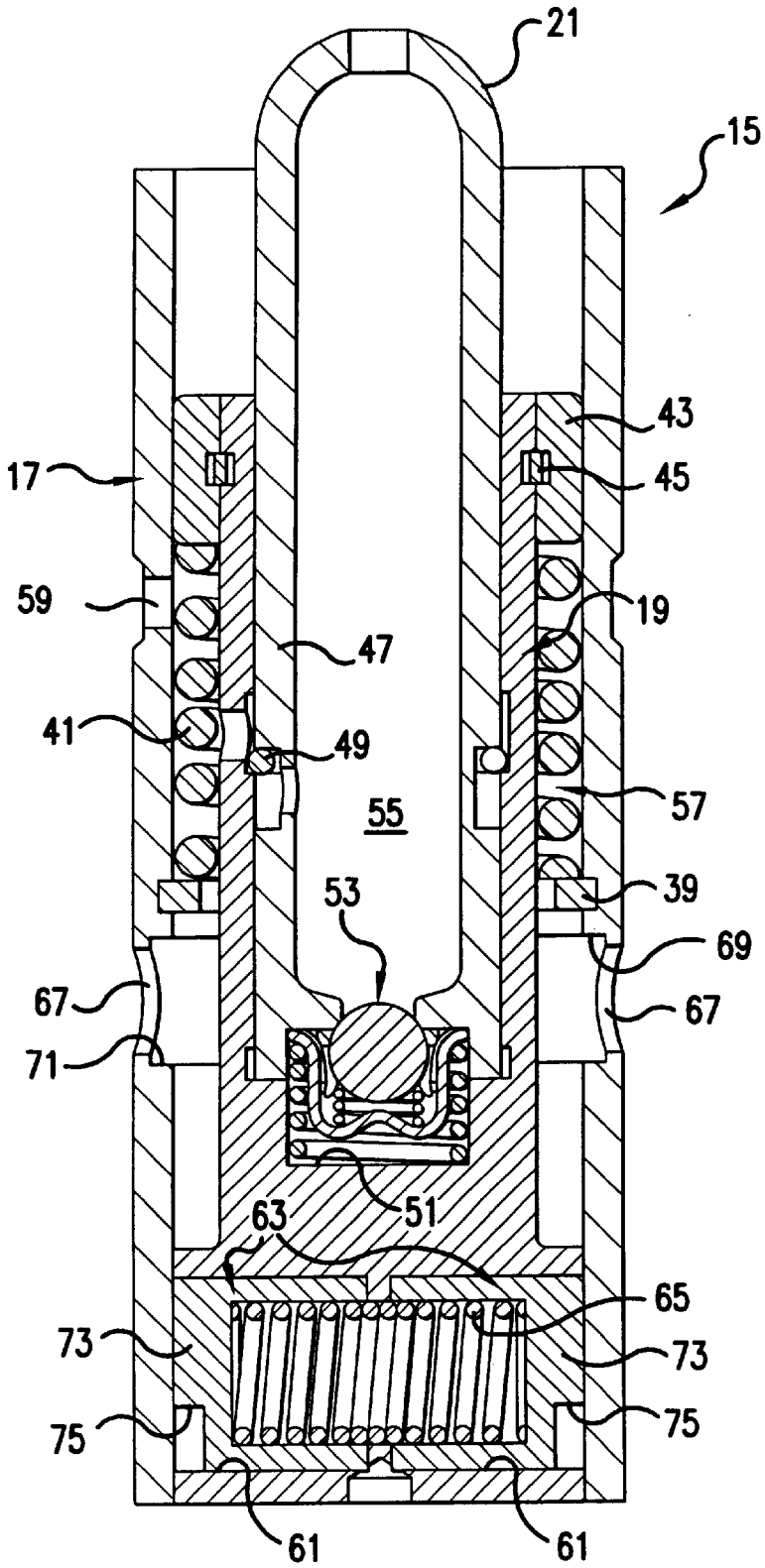
FIG. 2 is a greatly enlarged, axial cross-section illustrating the valve deactivator assembly of the present invention in its unlatched condition.

Referring now primarily to FIG. 2, those skilled in the art should understand that the invention is not limited to any particular valve deactivator or HLA configuration, except as is noted hereinafter in the appended claims. Thus, the present invention is being illustrated and described in connection with a valve deactivating HLA for use with an end pivot rocker arm, but the invention could also be utilized in, for example, a valve deactivating roller follower for a push rod type gear train.

In FIG. 2, the valve deactivator assembly 15 is shown in its unlatched condition, with the inner body member 19 and ball plunger portion 21 fully "retracted", i.e., moved as far downward as possible within the outer body member 17. Disposed in engagement with an internal groove formed in the outer body member 17 is a stop clip 39 which serves as the lower spring seat for a lost motion compression spring 41. At its upper end, the spring 41 is seated against a pilot ring 43, which is preferably fixed to move with the upper end of the inner body member 19 by any suitable means, such as a wire snap ring 45. Thus, the compression spring 41 biases the inner body member 19 and the ball plunger portion 21 "upward" in FIG. 2, toward a fully extended condition (the condition shown in FIG. 3), in the absence of a downward force being exerted on the ball plunger 21 by the socket 25 of the rocker arm 27, when the lobe of the cam 37 is in the position shown in FIG. 1.

Referring still primarily to FIG. 2, the ball plunger portion 21 is formed at the upper end of a generally cylindrical plunger element 47 which is retained for limited reciprocal movement within the inner body member 19 by means of a wire snap ring 49. The inner body member 19 defines a stepped bore 51 which serves as the high pressure chamber for a hydraulic lash compensation element, generally designated 53, which may be of a type well known to those skilled in the art, is not an essential feature of the invention, and will not be described further herein. Disposed within the plunger element 47 is a fluid reservoir 55, which is in fluid communication with the high pressure chamber 51 by means of the lash compensation element 53, in a manner well known to those skilled in the art.

Disposed between the outer body member 17 and the inner body member 19 is a generally cylindrical chamber 57, in which the compression spring 41 is disposed. The chamber 57 would typically be filled with engine lubricating oil, some of which would enter through a port 59 formed in the wall of the outer body member 17.

The lower portion of the inner body member 19 defines a pair of diametrically arranged bores 61 which, by way of example only, are illustrated herein as being generally cylindrical, but may be of a variety of configurations. Disposed within each bore 61 is a latching element 63, and in the subject embodiment, the latching members 63 are identical, and thus may be interchangeable. Preferably, the latching elements 63 are hollow to receive therein a single compression spring 65. With the bores 61 arranged diametrically, a single spring 65 is sufficient to bias both latching elements 63 radially outward toward a latched condition (as shown in FIG. 3).

Figure 3:
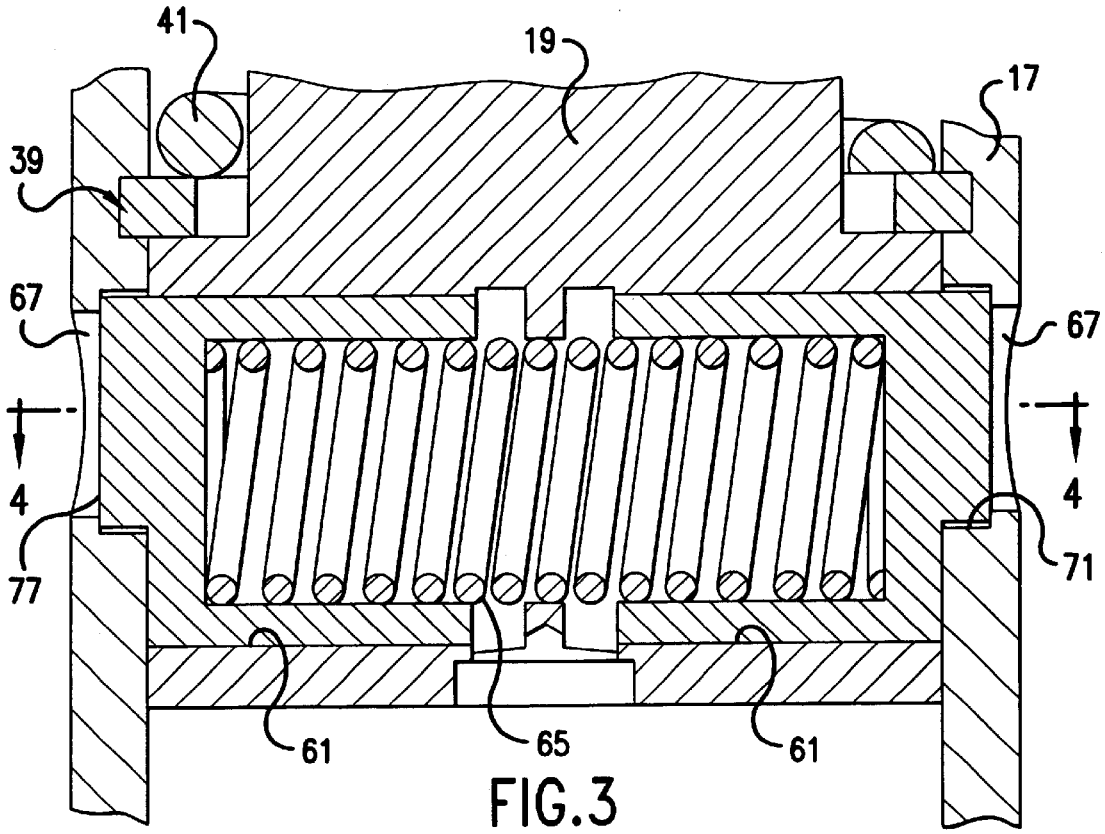
FIG. 3 is a further enlarged, fragmentary, axial cross-section of a portion of the valve deactivator assembly of the present invention in its latched condition.

Referring now to FIGS. 2 and 3 together, the outer body member 17 defines, by way of example only, a pair of ports 67, at least one of which is in communication with the engine oil passage 23 (see FIG. 1). The ports 67 open into an annular, internal groove 69, the groove 69 forming an annular latch surface 71 (see FIG. 4). Each of the latching elements 63 includes a latch portion 73, each of which is generally half-circular (see FIG. 5), and each of which includes on its underside, a generally flat, planar stop surface 75. Each latch portion 73 includes a radially outer end surface 77, which in the subject embodiment, has about the same radius of curvature as the adjacent annular, internal groove 69.

Figure 5:
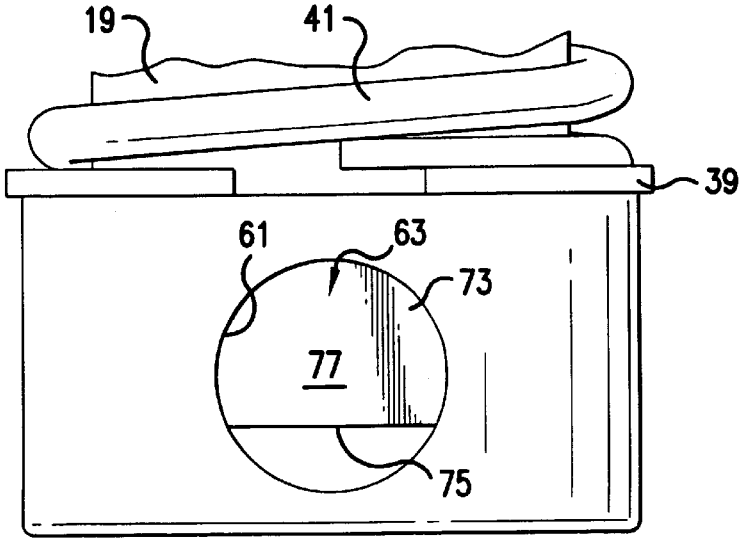
FIG. 5 is a view taken on line 5–5 of FIG. 4.
Figure 4:
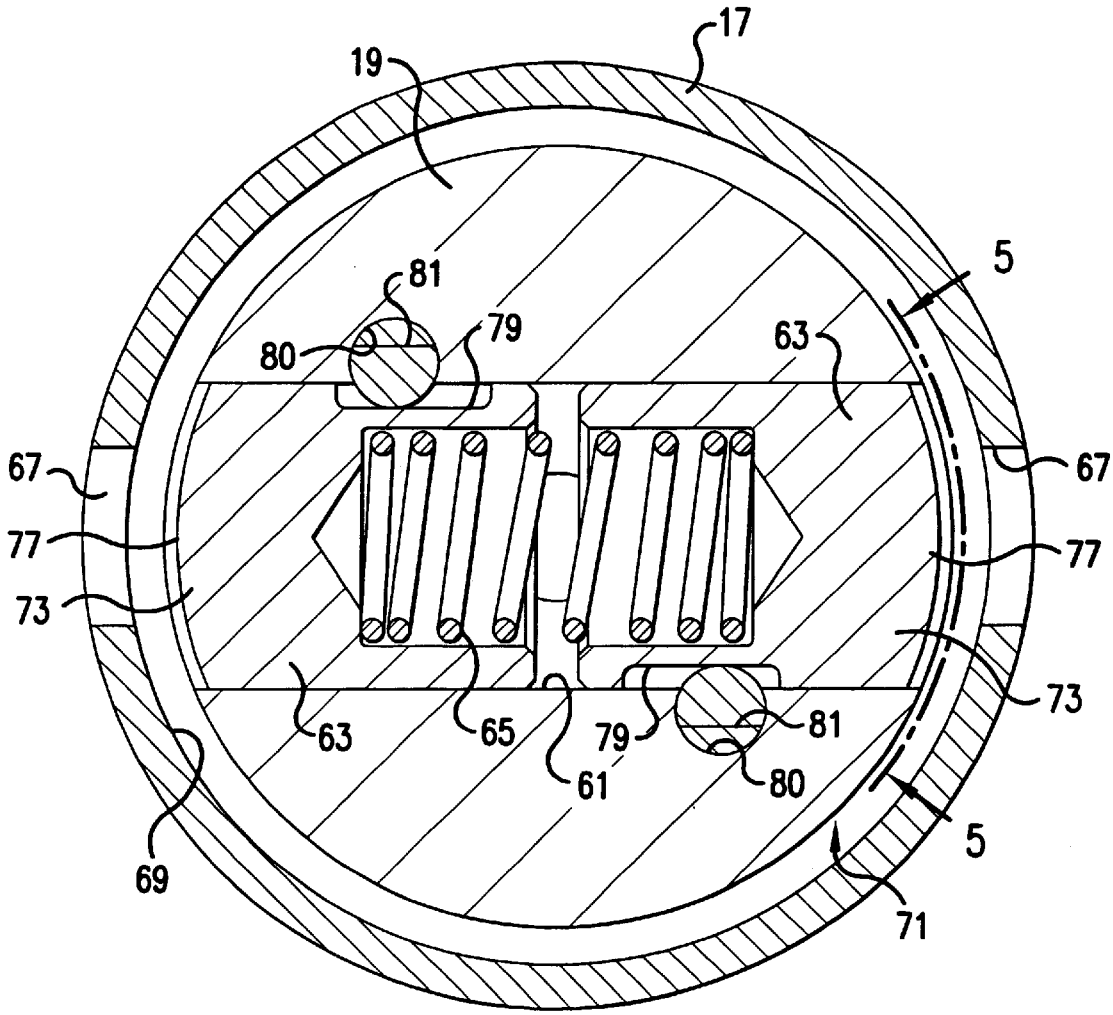
FIG. 4 is a transverse cross-section, taken on line 4–4 of FIG. 3, but with the latching elements retracted, illustrating one important aspect of the present invention.

Each latching element 63 defines a flat 79, which is preferably perpendicular to the planar stop surface 75. Adjacent each flat 79, the inner body member 19 defines a vertical bore 80, and into each bore 80, after the latching elements 63 are in place in the bores 61, a pin 81 is pressed in and is disposed closely spaced apart from the flat 79, as shown in FIG. 4. The pins 81 serve two primary functions, one of which is to retain the latching elements 63 within the bores 61 as the inner body member 19 is handled during assembly of the entire deactivator assembly 15. The other function is to maintain the rotational orientation of each latching element 63 within its bore 61, as shown in FIG. 5, so that both of the planar stop surfaces 75 will always remain substantially parallel to the annular latch surface 71.

As a result of the above-described parallel relationship of the surfaces 71 and 75, the inner body member 19 can have any rotational orientation within the outer body member 17, and proper latching will still occur, which is one important aspect of the present invention. In other words, although in FIG. 4 the latch portion 73 is shown as disposed adjacent the ports 67, such is not necessary, and the inner body member 19 could be inserted within the outer body member 17 at any relative rotational orientation. Another result of the parallel relationship of the surfaces 71 and 75 is that any forces exerted on the deactivator assembly 15 are taken up by the face-to-face engagement of the two planar stop surfaces 75 and the annular latch surface 71, rather than by a cylindrical member within a circular opening (line-to-line contact) as was known in the prior art.

When it is desired to deactivate the engine poppet valve 33 from the latched condition shown in FIG. 3, an appropriate signal is transmitted to the engine oil pressure system, increasing the oil pressure in the engine oil passage 23. The increased oil pressure is communicated through one of the ports 67, filling the annular, internal groove 69 with pressurized fluid. The pressurized fluid contacts the end surfaces 77 of the latch portions 73, biasing the latching elements 63 from the latched condition shown in FIG. 3 toward an unlatched condition as shown in FIG. 4, with the stop surfaces 75 retracted and out of engagement with the annular latch surface 71. With the latching elements 63 in their unlatched condition, the inner body member 19 may be moved by external forces (as explained previously) from its filly extended position as shown in FIG. 3 to its fully retracted position as shown in FIG. 2, thus introducing lost motion into the valve gear train.

As is typical in the valve deactivator art, mode transitions, either from the latched condition to the unlatched condition, or vice versa, occur only when the cam 37 is on the base circle portion. As is well known to those skilled in the art, mode transitions are accomplished only on base circle in order that the mode change occurs while the valve deactivator assembly 15, and more specifically, the latching mechanism, is not under load. For example, in FIG. 3, even though the valve deactivator assembly 15 is in the latched condition, when the cam 37 has its base circle portion engaging the follower 35, the latching elements 63 can easily be slid from the latched condition shown to the unlatched condition. However, after the cam 37 rotates to the position shown in FIG. 1, there is sufficient downward force on the ball plunger 21, and thus on the inner body member 19, such that the frictional engagement force between the annular latch surface 71 and the stop surfaces 75 would be enough such that the latching elements 63 could not be biased radially inward to their unlatched positions, except perhaps with substantially higher fluid pressure. Those skilled in the art will understand that such fluid pressures of the type which would be required are generally not available and would probably not be desirable.

Figure 6:
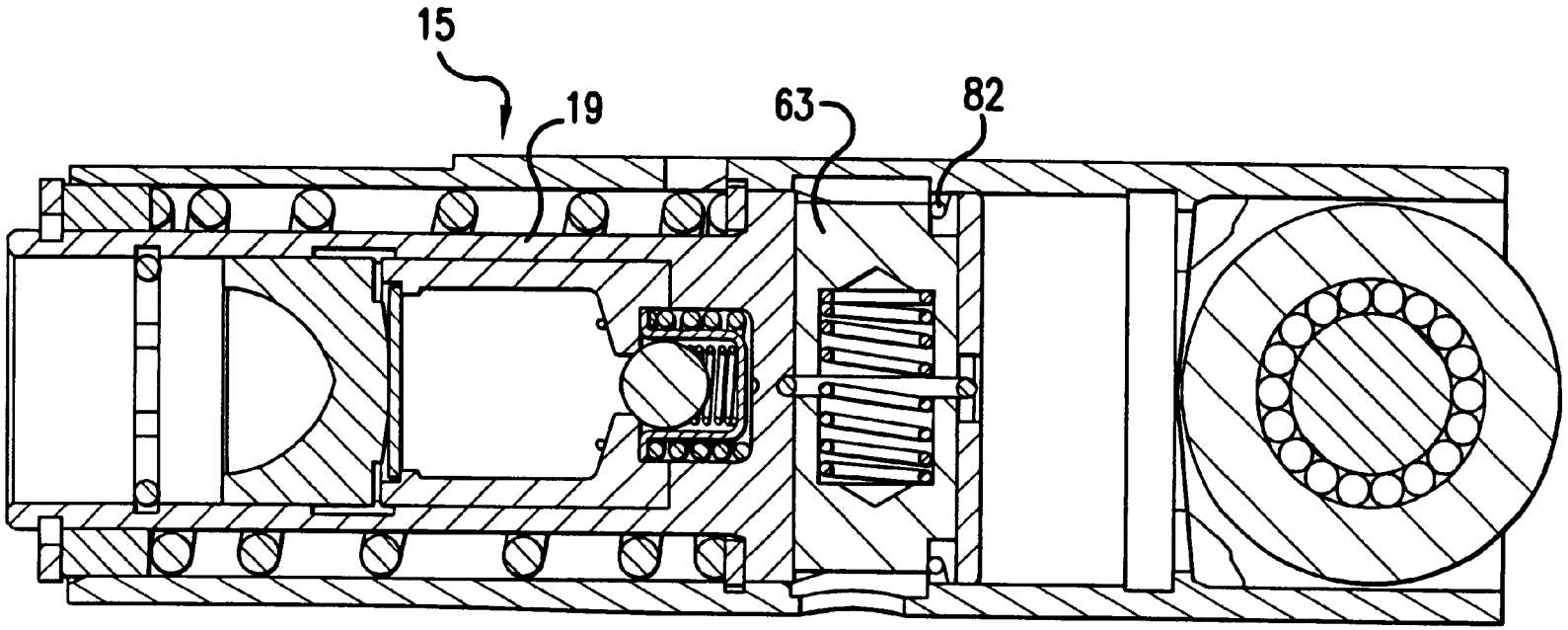
FIG. 6 is a view showing an alternative latching means using a wire annular ring.

FIG. 6 illustrates the invention in a slightly different form for use in connection with a specific valve train, using a wire annular ring 82 to orient the latch member 63.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve deactivator assembly for an internal combustion engine of the type having valve means for controlling the flow to and from a combustion chamber, drive means for providing cyclical motion for opening and closing said valve means in timed relationship to the events in said combustion chamber, and valve gear means operative in response to said cyclical motion to effect cyclical opening and closing of said valve means; said valve deactivator assembly comprising part of said valve gear means and including an outer body member and an inner body member disposed within said outer body member and being reciprocable relative thereto, and a spring biasing said inner body member toward an axially extended position relative to said outer body member; a latch assembly wholly disposed within said inner body member when said outer and inner body members are in an unlatched condition, said latch assembly including a radially moveable latch member and spring means biasing said latch member toward a latched condition; a source of pressurized fluid operably associated with said latch assembly and operable to bias said latch member toward said unlatched condition; characterized by:

(a) said latch assembly further comprises said outer body member defining a generally annular, internal groove including an annular latch surface and at least one fluid port disposed in open fluid communication with said annular, internal groove and in fluid communication with said source of pressurized fluid;

(b) said latch member defining a generally planar stop surface oriented generally parallel to said annular latch surface and disposed for face-to-face engagement therewith when said latch member is in said latched condition, whereby said inner body member may have any rotational orientation relative to said outer body member.

2. A valve deactivator assembly as claimed in claim 1, characterized by said latch assembly including a pair of diametrically opposite, radially moveable latch members, said spring means comprising a single compression spring biasing both of said latch members radially outward toward said latched condition, each of said latch members defining said generally planar stop surface.

3. A valve deactivator assembly as claimed in claim 1, characterized by said engine including a cylinder head defining a bore, said outer body member of said valve deactivator assembly being generally cylindrical, and disposed within said bore.

4. A valve deactivator assembly as claimed in claim 1, characterized by said outer body member being generally cylindrical and hollow, and said inner body member being generally cylindrical and hollow, said outer and inner body members defining therebetween a generally annular chamber.

5. A valve deactivator assembly as claimed in claim 4, characterized by said spring biasing said inner body member toward said axially extended position comprising a coil compression spring disposed within said annular chamber, said spring having an upper end seated relative to said inner body member, and a lower end seated relative to said outer body member, said latched condition of said latch assembly occurring when said inner body member is in said axially extended position.

6. A valve deactivator assembly as claimed in claim 1, characterized by said latch member defining, on its outer periphery, a flat surface oriented generally perpendicular to said planar stop surface, said inner body member including a retention member disposed closely spaced apart from said flat surface, and operable to orient said latch member whereby said stop surface remains substantially parallel to said annular latch surface.

7. A valve deactivator assembly as claimed in claim 1, characterized by said latch member defining, on its outer periphery, a flat surface oriented generally perpendicular to said planar stop surface, said inner body member including a wire annular ring supported by said inner body member acting on said planar stop surface to orient the latch member whereby said stop surface remains substantially parallel to said annular latch surface.

* * * * *